US007333076B2

(12) United States Patent
Nakamura et al.

(10) Patent No.: US 7,333,076 B2
(45) Date of Patent: Feb. 19, 2008

(54) METHOD FOR DRIVING DISPLAY PANEL

(75) Inventors: Hideto Nakamura, Yamanashi-ken (JP); Mitsunori Taguchi, Yamanashi-ken (JP); Tsutomu Tokunaga, Yamanashi-ken (JP); Shigeru Iwaoka, Yamanashi-ken (JP); Nobuhiko Saegusa, Yamanashi-ken (JP)

(73) Assignees: Pioneer Corporation, Tokyo (JP); Pioneer Display Products Corporation, Shizuoka (JP)

( * ) Notice: Subject to any disclaimer, the term of this patent is extended or adjusted under 35 U.S.C. 154(b) by 369 days.

(21) Appl. No.: 10/659,263

(22) Filed: Sep. 11, 2003

(65) Prior Publication Data

US 2004/0051689 A1 Mar. 18, 2004

(30) Foreign Application Priority Data

Sep. 13, 2002 (JP) ..... 2002-268887

(51) Int. Cl.
*G09G 3/28* (2006.01)

(52) U.S. Cl. ..... 345/60; 345/204

(58) Field of Classification Search ..... 345/60, 345/63, 67, 204

See application file for complete search history.

(56) References Cited

U.S. PATENT DOCUMENTS 6,144,348 A * 11/2000 Kanazawa et al. ..... 345/60
6,175,194 B1 * 1/2001 Saegusa et al. ..... 315/169.4
6,677,920 B2 * 1/2004 Huang et al. ..... 345/60
6,717,557 B2 * 4/2004 Ishizuka ..... 345/60
6,836,261 B1 * 12/2004 Kishi et al. ..... 345/60
2002/0135542 A1 * 9/2002 Kim et al. ..... 345/50
2003/0006945 A1 * 1/2003 Lim et al. ..... 345/67
2003/0090441 A1 * 5/2003 Kim et al. ..... 345/60

FOREIGN PATENT DOCUMENTS

JP 2001-154630 A 6/2001

* cited by examiner

*Primary Examiner*—Amr A. Awad
*Assistant Examiner*—Stephen G Sherman
(74) *Attorney, Agent, or Firm*—Sughrue Mion, PLLC

(57) ABSTRACT

A method for driving a display panel with which the dark contrast can be improved is provided. Each of at least two successive sub-fields including a leading sub-field includes a selective write addressing step for setting the discharge cells to a lighted discharge cell mode by selectively causing a writing discharge in the discharge cells in accordance with the video signal. The sub-fields following at least two sub-fields include a selective erasure addressing step for setting the discharge cells to an unlighted discharge cell mode by selectively causing an erasing discharge in the discharge cells in accordance with the video signal and an emission sustain step for repeatedly causing a sustain discharge corresponding to a weighting of that sub-field only in the discharge cells that are in the lighted discharge cell mode. The last sub-field of each field includes a first erasing step for inducing a first erasing discharge between the column electrode and one of the row electrodes of the row electrode pair belonging to the discharge cells that have been set to the unlighted discharge cell mode in the selective erasure addressing step and a second erasing step for inducing a second erasing discharge between the row electrodes of the row electrode pair belonging to the discharge cells that have been set to the lighted discharge cell mode in the selective write addressing step, the first erasing step and the second erasing step being performed immediately after the emission sustain step.

8 Claims, 12 Drawing Sheets

PRIOR ART

FIG. 2

● : SELECTIVE ERASING DISCHARGE
○ : EMISSION SF

| GRADATION | CONVERSION TABLE | | | | | | | | | | | | | EMISSION DRIVING PATTERN | | | | | | | | | | | | DISPLAY LUMINANCE |
|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | SF 1 | SF 2 | SF 3 | SF 4 | SF 5 | SF 6 | SF 7 | SF 8 | SF 9 | SF 10 | SF 11 | SF 12 | |
| 1 | 0000 | 1 | 0 | 0 | 0 | 0 | 0 | 0 | 0 | 0 | 0 | 0 | 0 | ● | | | | | | | | | | | | 0 |
| 2 | 0001 | 0 | 1 | 0 | 0 | 0 | 0 | 0 | 0 | 0 | 0 | 0 | 0 | ○ | ● | | | | | | | | | | | 1 |
| 3 | 0010 | 0 | 0 | 1 | 0 | 0 | 0 | 0 | 0 | 0 | 0 | 0 | 0 | ○ | ○ | ● | | | | | | | | | | 3 |
| 4 | 0011 | 0 | 0 | 0 | 1 | 0 | 0 | 0 | 0 | 0 | 0 | 0 | 0 | ○ | ○ | ○ | ● | | | | | | | | | 7 |
| 5 | 0100 | 0 | 0 | 0 | 0 | 1 | 0 | 0 | 0 | 0 | 0 | 0 | 0 | ○ | ○ | ○ | ○ | ● | | | | | | | | 14 |
| 6 | 0101 | 0 | 0 | 0 | 0 | 0 | 1 | 0 | 0 | 0 | 0 | 0 | 0 | ○ | ○ | ○ | ○ | ○ | ● | | | | | | | 25 |
| 7 | 0110 | 0 | 0 | 0 | 0 | 0 | 0 | 1 | 0 | 0 | 0 | 0 | 0 | ○ | ○ | ○ | ○ | ○ | ○ | ● | | | | | | 39 |
| 8 | 0111 | 0 | 0 | 0 | 0 | 0 | 0 | 0 | 1 | 0 | 0 | 0 | 0 | ○ | ○ | ○ | ○ | ○ | ○ | ○ | ● | | | | | 59 |
| 9 | 1000 | 0 | 0 | 0 | 0 | 0 | 0 | 0 | 0 | 1 | 0 | 0 | 0 | ○ | ○ | ○ | ○ | ○ | ○ | ○ | ○ | ● | | | | 84 |
| 10 | 1001 | 0 | 0 | 0 | 0 | 0 | 0 | 0 | 0 | 0 | 1 | 0 | 0 | ○ | ○ | ○ | ○ | ○ | ○ | ○ | ○ | ○ | ● | | | 117 |
| 11 | 1010 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ● | | 157 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 205 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 |

FIG. 6

| GRADATION DRIVING | CONVERSION TABLE | | EMISSION PATTERN | | | | | | | | | | | | LUMINANCE |
|---|---|---|---|---|---|---|---|---|---|---|---|---|---|---|---|
| | PDs | GD 1 2 3 4 · · · · · · · · 12 | SF 1 | SF 2 | SF 3 | SF 4 | SF 5 | SF 6 | SF 7 | SF 8 | SF 9 | SF 10 | SF 11 | SF 12 | |
| 1 | 0000 | 0 * * * * * * * * * * * * | | | | | | | | | | | | | 0 |
| 2 | 0001 | 1 1 * * * * * * * * * * * | ◎ | ● | | | | | | | | | | | 1 |
| 3 | 0010 | 1 0 1 * * * * * * * * * * | ◎ | ○ | ● | | | | | | | | | | 3 |
| 4 | 0011 | 1 0 0 1 * * * * * * * * * | ◎ | ○ | ○ | ● | | | | | | | | | 7 |
| 5 | 0100 | 1 0 0 0 1 * * * * * * * * | ◎ | ○ | ○ | ○ | ● | | | | | | | | 13 |
| 6 | 0101 | 1 0 0 0 0 1 * * * * * * * | ◎ | ○ | ○ | ○ | ○ | ● | | | | | | | 25 |
| 7 | 0110 | 1 0 0 0 0 0 1 * * * * * * | ◎ | ○ | ○ | ○ | ○ | ○ | ● | | | | | | 39 |
| 8 | 0111 | 1 0 0 0 0 0 0 1 * * * * * | ◎ | ○ | ○ | ○ | ○ | ○ | ○ | ● | | | | | 59 |
| 9 | 1000 | 1 0 0 0 0 0 0 0 1 * * * * | ◎ | ○ | ○ | ○ | ○ | ○ | ○ | ○ | ● | | | | 84 |
| 10 | 1001 | 1 0 0 0 0 0 0 0 0 1 * * * | ◎ | ○ | ○ | ○ | ○ | ○ | ○ | ○ | ○ | ● | | | 117 |
| 11 | 1010 | 1 0 0 0 0 0 0 0 0 0 1 * * | ◎ | ○ | ○ | ○ | ○ | ○ | ○ | ○ | ○ | ○ | ● | | 157 |
| 12 | 1011 | 1 0 0 0 0 0 0 0 0 0 0 1 * | ◎ | ○ | ○ | ○ | ○ | ○ | ○ | ○ | ○ | ○ | ○ | ● | 205 |
| 13 | 1100 | 1 0 0 0 0 0 0 0 0 0 0 0 0 | ◎ | ○ | ○ | ○ | ○ | ○ | ○ | ○ | ○ | ○ | ○ | ○ | 255 |

*: 0 OR 1

◎ : SELECTIVE WRITING

● : SELECTIVE ERASURE

○ : SUSTAIN DISCHARGE EMISSION SF

NO SELECTIVE WRITING DISCHARGE AND NO SELECTIVE ERASING DISCHARGE

SELECTIVE WRITING DISCHARGE AND SELECTIVE ERASING DISCHARGE

SELECTIVE WRITING DISCHARGE ONLY

FIG. 12

| GRADATION DRIVING | CONVERSION TABLE | | EMISSION PATTERN | | | | | | | | | | | | LUMINANCE |
|---|---|---|---|---|---|---|---|---|---|---|---|---|---|---|---|
| | PDs | GD 1 2 3 4 · · · · · · · · 12 | SF 1 | SF 2 | SF 3 | SF 4 | SF 5 | SF 6 | SF 7 | SF 8 | SF 9 | SF 10 | SF 11 | SF 12 | |
| 1 | 0000 | 0 * * * * * * * * * * * | | | | | | | | | | | | | 0 |
| 2 | 0001 | 0 1 1 * * * * * * * * * | | ◎ | ● | | | | | | | | | | 1 |
| 3 | 0010 | 1 1 1 * * * * * * * * * | ◎ | ◎ | ● | | | | | | | | | | 3 |
| 4 | 0011 | 1 1 0 1 * * * * * * * * | ◎ | ◎ | ○ | ● | | | | | | | | | 7 |
| 5 | 0100 | 1 1 0 0 1 * * * * * * * | ◎ | ◎ | ○ | ○ | ● | | | | | | | | 13 |
| 6 | 0101 | 1 1 0 0 0 1 * * * * * * | ◎ | ◎ | ○ | ○ | ○ | ● | | | | | | | 25 |
| 7 | 0110 | 1 1 0 0 0 0 1 * * * * * | ◎ | ◎ | ○ | ○ | ○ | ○ | ● | | | | | | 39 |
| 8 | 0111 | 1 1 0 0 0 0 0 1 * * * * | ◎ | ◎ | ○ | ○ | ○ | ○ | ○ | ● | | | | | 59 |
| 9 | 1000 | 1 1 0 0 0 0 0 0 1 * * * | ◎ | ◎ | ○ | ○ | ○ | ○ | ○ | ○ | ● | | | | 84 |
| 10 | 1001 | 1 1 0 0 0 0 0 0 0 1 * * | ◎ | ◎ | ○ | ○ | ○ | ○ | ○ | ○ | ○ | ● | | | 117 |
| 11 | 1010 | 1 1 0 0 0 0 0 0 0 0 1 * | ◎ | ◎ | ○ | ○ | ○ | ○ | ○ | ○ | ○ | ○ | ● | | 157 |
| 12 | 1011 | 1 1 0 0 0 0 0 0 0 0 0 1 | ◎ | ◎ | ○ | ○ | ○ | ○ | ○ | ○ | ○ | ○ | ○ | ● | 205 |
| 13 | 1100 | 1 1 0 0 0 0 0 0 0 0 0 0 | ◎ | ◎ | ○ | ○ | ○ | ○ | ○ | ○ | ○ | ○ | ○ | ○ | 255 |

*: 0 OR 1

◎ : SELECTIVE WRITING

● : SELECTIVE ERASURE

○ : SUSTAIN DISCHARGE EMISSION SF

METHOD FOR DRIVING DISPLAY PANEL

BACKGROUND OF THE INVENTION

1. Field of the Invention

The present invention relates to a method for driving a matrix display panel.

2. Description of the Related Art

Interest has been growing in recent years toward plasma display panels (hereafter, "PDP") in which a plurality of discharge cells are arranged in a matrix shape as two dimensional image display panels. The number of gradations of luminance that can be expressed by a PDP depends on the number of pixel data bits for each pixel based on the video signal.

As a method for displaying gradations in a PDP, the sub-field method is known, in which the cells are driven by dividing the display period of one field into a plurality of sub-fields. In the sub-field method, the display period of one field is divided into a plurality of sub-fields. Each sub-field includes an address period in which each pixel is set to a lighted mode or an unlighted mode in accordance with the pixel data, and an emission sustain period in which only the pixels in the lighted mode are lighted (caused to emit light) for a period corresponding to the weighting of that sub-field. That is, for each sub-field, it is set whether the discharge cells are to emit light within that sub-field (address period), and the discharge cells that are set to the lighted mode emit light only for the period assigned to that sub-field (referred to as an emission sustain period). Consequently, there are occasions in which, in one field, sub-fields for a light-emitting state and sub-fields for an unlighted (non-light emitting) state, are mixed. At such time, intermediate levels of luminance corresponding to the total light emitting period of all the sub-fields can be seen.

FIG. 1 shows a schematic example of a PDP emission driving format, such as the one disclosed in Japanese Patent Kokai No. 2001-154630 for example. One field of the video signal is made up of twelve sub-fields, SF1 to SF12. Each sub-field includes an addressing step Wc, in which each discharge cell of the PDP is set to either a "lighted discharge cell mode" (that is, an operative mode), or an "unlighted discharge cell mode" (that is, an inoperative mode) based on the input video signal, and an emission sustain step Ic, in which only the discharge cells in the "lighted discharge cell mode" are caused to emit light for a period (number of times) corresponding to the weighting of each sub-field. A universal reset step Rc that initializes all the discharge cells of the PDP to "lighted discharge cell mode" is executed only in the leading sub-field SF1. An erasing step E is executed only in the last sub-field SF12.

FIG. 2 shows a pixel data conversion table and a discharge cell emission driving pattern such as those disclosed in Japanese Patent Kokai No.2001-154630A for example.

Pixel data, for example 8-bit pixel data, can be obtained by sampling the video signal. The pixel data is subjected to multi-gradation processing. With this processing, multi-gradation pixel data $PD_s$ are generated that reduce the bit number to 4 bits while sustaining the actual number of gradations. The multi-gradation pixel data $PD_s$ are converted to pixel driving data GD made up of 1st to 12th bits in accordance with a conversion table such as that shown in FIG. 2. The 1st to 12th bits correspond to the sub-fields SF1 to SF12, respectively.

FIG. 3 shows the timing for applying the various driving pulses, which are applied to the row electrodes and column electrodes of the PDP in accordance with the emission driving format shown in FIG. 2. A known example of this is disclosed in Japanese Patent Application Kokai No. 2001-154630. It should be noted that FIG. 3 shows the case of driving by a selective erasing method (one reset/one selective erasure addressing method).

In the universal reset step Rc of sub-field SF1, a negative reset pulse $RP_X$ is applied to the row electrodes $X_1$ to $X_n$. At the same time as the reset pulse $RP_X$ is applied, a positive reset pulse $RP_Y$ is applied to the row electrodes $Y_1$ and $Y_n$. All the discharge cells of the PDP are reset and discharged in response to the reset pulses $RP_X$ and $RP_Y$, and a predetermined wall charge is formed uniformly in the discharge cells. This initializes all the discharge cells to the "lighted discharge cell mode."

In the addressing step Wc of each sub-field, pixel data pulses DP are generated that have voltages corresponding to the logic level of the pixel driving data bits DB1 to DB12. The pixel driving data bits DB1 to DB12 correspond to the first through twelfth bits of the pixel driving data GD. For example, in the addressing step Wc of sub-field SF1, the pixel driving data bit DB1 is first converted to a pixel data pulse that has a voltage corresponding to that logic level. The pixel data pulse groups $DP1_1$ to $DP1_n$ are each successively applied to the column electrodes $D_1$ to $D_m$, with m pixel data pulses corresponding to the first row applied as pixel data pulse group $DP1_1$, m pixel data pulses corresponding to the second row applied as pixel data pulse group $DP1_2$, and m pixel data pulses corresponding to the n-th row applied as pixel data pulse group $DP1_n$.

Furthermore, in the addressing step Wc, negative scan pulses SP are successively applied to the row electrodes $Y_1$ to $Y_n$ at the same timing as the timing of each application of the pixel data pulse groups DP. At this time, discharges (selective erasing discharges) are caused only at the discharge cells at the intersections between the row electrodes to which a scan pulse SP has been applied and the column electrodes to which a high-voltage pixel data pulse has been applied, and the wall charge remaining within the discharge cells is selectively erased.

With this selective erasing discharge, the discharge cells that were initialized to the "lighted discharge cell mode" at the universal reset step Rc transition to the "unlighted discharge cell mode." On the other hand, the discharge cells in which no selective erasing discharge is induced sustain the state to which they have been initialized at the universal reset step Rc, that is, the "lighted discharge cell mode."

As shown in FIG. 3, in the emission sustain step Ic of each sub-field, positive sustain pulses $IP_X$ and $IP_Y$ are alternately applied to the row electrodes $X_1$ to $X_n$ and $Y_1$ to $Y_n$. The number of applications of the sustain pulse IP in each emission sustain step Ic is set to a predetermined proportion for each of the sub-fields SF1 to SF12. For example, as shown in FIG. 1, the number of times of application of sustain pulses IP for each sub-field is set to the ratio SF1:SF2:SF3:SF4:SF5:SF6:SF7:SF8:SF9:SF10:SF11:SF12=1:2:4:7:11:14:20:25:33:40:48:50.

Only the discharge cells in which the wall charge remains, that is, only the discharge cells that have been set to the "lighted discharge cell mode" in the addressing step Wc, have a discharge sustained every time the sustain pulses $IP_X$ and $IP_Y$ are applied. Thus, the discharge cells that are set to the "lighted discharge cell mode" sustain an emission state with that sustain discharge for the number of times that is assigned to each sub-field.

An erasing step E is executed only for the last sub-field SF12. In the erasing step E, a positive erasing pulse AP is generated, and applied to the column electrodes $D_1$ to $D_m$.

Furthermore, a negative erasing pulse EP is generated with the same timing as the timing for applying the positive erasing pulse AP, and is applied to the row electrodes $Y_1$ to $Y_n$. An erasing discharge is induced in all the discharge cells of the PDP by the simultaneous application of these erasing pulses AP and EP, and all the wall charges that remain in the discharge cells are extinguished. All the discharge cells in the PDP go into the "unlighted discharge cell mode" due to the erasing discharges.

In the above-described driving method, it is only in one of the sub-fields that a selective erasing discharge occurs in the addressing step, and only for discharge cells that are in a light-emitting state in the immediately preceding sub-field. This causes successive lighting starting with the leading sub-field, and with N (for example 12) sub-fields, N+1 (for example 13) gradations can be displayed. Gradations are displayed by the total number of light emissions of the sustain discharges for each sub-field, in accordance with the input video signal.

Human vision has logarithmic characteristics, and humans are sensitive, for example, to tone changes in images that show dark scenes. However, by driving a PDP as described above, selective erasing discharges accompanied by light emissions are induced even when displaying black images in which the luminance is zero as shown in FIG. 2. Thus, there is the problem that the so-called dark contrast, which is the contrast for displaying images that show dark scenes, deteriorates.

SUMMARY OF THE INVENTION

To solve the above-described problems, it is an object of the present invention to provide a method for driving a display panel with which the dark contrast can be improved.

One aspect of the invention is a method for driving a display panel in which discharge cells are formed at intersections between a plurality of row electrode pairs, which correspond to display lines, and a plurality of column electrodes intersecting with the row electrode pairs, the display panel being driven in sub-fields, each field of a video signal being constituted by a plurality of the sub-fields. Each of at least two successive sub-fields including a leading sub-field includes a selective write addressing step for setting the discharge cells to a lighted discharge cell mode by applying a scan pulse to one row electrode of the row electrode pair while applying a data pulse corresponding to the video signal to the column electrode thereby selectively causing a writing discharge in the discharge cells. The sub-fields following at least two sub-fields include a selective erasure addressing step for setting the discharge cells to a unlighted discharge cell mode by applying the scan pulse to one row electrode of the row electrode pair while applying the data pulse corresponding to the video signal to the column electrode thereby selectively causing an erasing discharge in the discharge cells and an emission sustain step for applying sustain pulses to the row electrode pairs thereby repeatedly causing a sustain discharge corresponding to a weighting of that sub-field only in the discharge cells that are in the lighted discharge cell mode. The last sub-field of each field includes a first erasing step for inducing a first erasing discharge between the column electrode and one of the row electrodes of the row electrode pair belonging to the discharge cells that have been set to the unlighted discharge cell mode in the selective erasure addressing step and a second erasing step for inducing a second erasing discharge between the row electrodes of the row electrode pair belonging to the discharge cells that have been set to the lighted discharge cell mode in the selective write addressing step, the first erasing step and the second erasing step being performed immediately after the emission sustain step.

Another aspect of the invention is a method for driving a display panel in which discharge cells are formed at intersections between a plurality of row electrode pairs, which correspond to display lines, and a plurality of column electrodes intersecting with the row electrode pairs. The display panel is driven in sub-fields, each field of a video signal being constituted by a plurality of the sub-fields. A leading sub-field of each field includes a selective write addressing step for setting the discharge cells to a unlighted discharge cell mode by applying the scan pulse to one row electrode of the row electrode pair while applying the data pulse corresponding to the video signal to the column electrode thereby selectively causing a erasing discharge in the discharge cells and an emission sustain step for applying sustain pulses to the row electrode pairs thereby causing a sustain discharge repeatedly for a number of times corresponding to a weighting of that sub-field only in the discharge cells that are in the lighted discharge cell mode. The sub-fields following the leading sub-field include a selective erasure addressing step for setting the discharge cells to a unlighted discharge cell mode by applying the scan pulse to one row electrode of the row electrode pair while applying the data pulse corresponding to the video signal to the column electrode thereby selectively causing a erasing discharge in the discharge cells and an emission sustain step for applying sustain pulses to the row electrode pairs thereby causing a sustain discharge repeatedly for a number of times corresponding to a weighting of that sub-field only in the discharge cells that are in the lighted discharge cell mode. The last sub-field of each field includes a first erasing step for inducing a first erasing discharge between the column electrode and one of the row electrodes of the row electrode pair belonging to the discharge cells that have been set to the unlighted discharge cell mode in the selective erasure addressing step and a second erasing step for inducing a second erasing discharge between the row electrodes of the row electrode pair belonging to the discharge cells that have been set to the lighted discharge cell mode in the selective write addressing step. The first erasing step and the second erasing step are performed immediately after the emission sustain step.

BRIEF DESCRIPTION OF THE DRAWINGS

FIG. 2 is a diagram showing pixel driving data GD obtained by pixel data conversions, and the gradations and the discharge cell emission driving pattern for these;

FIG. 6 is a diagram showing the data conversion table used in the driving data generating circuit 32, and the discharge cell emission driving pattern with gradation driving based on the pixel driving data GD;

FIG. 12 is a diagram showing another example of the data conversion table used in the driving data generating circuit 32, and the discharge cell emission driving pattern with gradation driving based on the pixel driving data GD.

DETAILED DESCRIPTION OF THE INVENTION

The following is a description of embodiments of the present invention with reference to the accompanying drawings.

Figure 1:
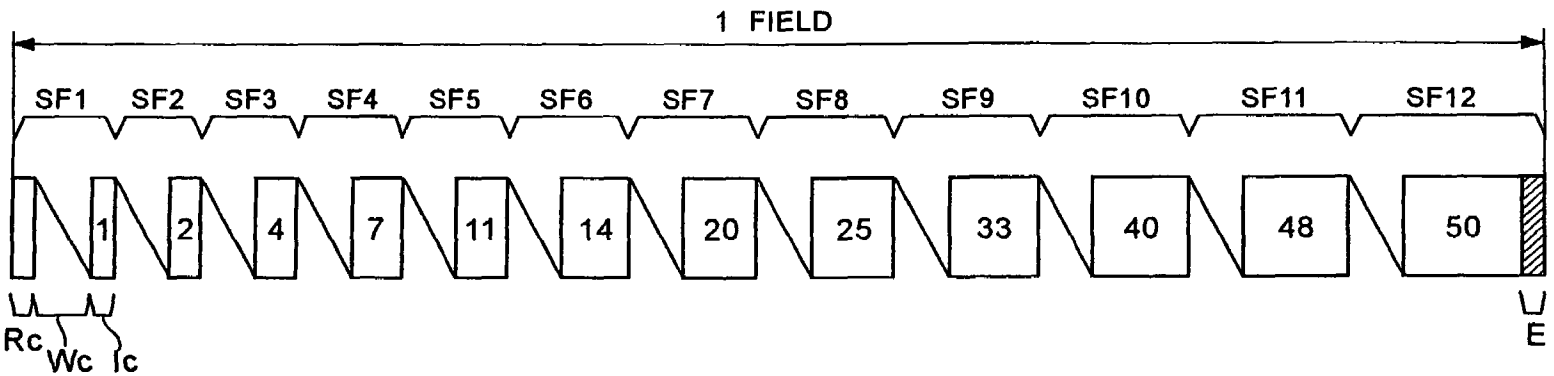
FIG. 1 PRIOR ART
FIG. 1 is a diagram showing an example of a PDP emission driving format according to the one reset/one selective erasure addressing method.
Figure 3:
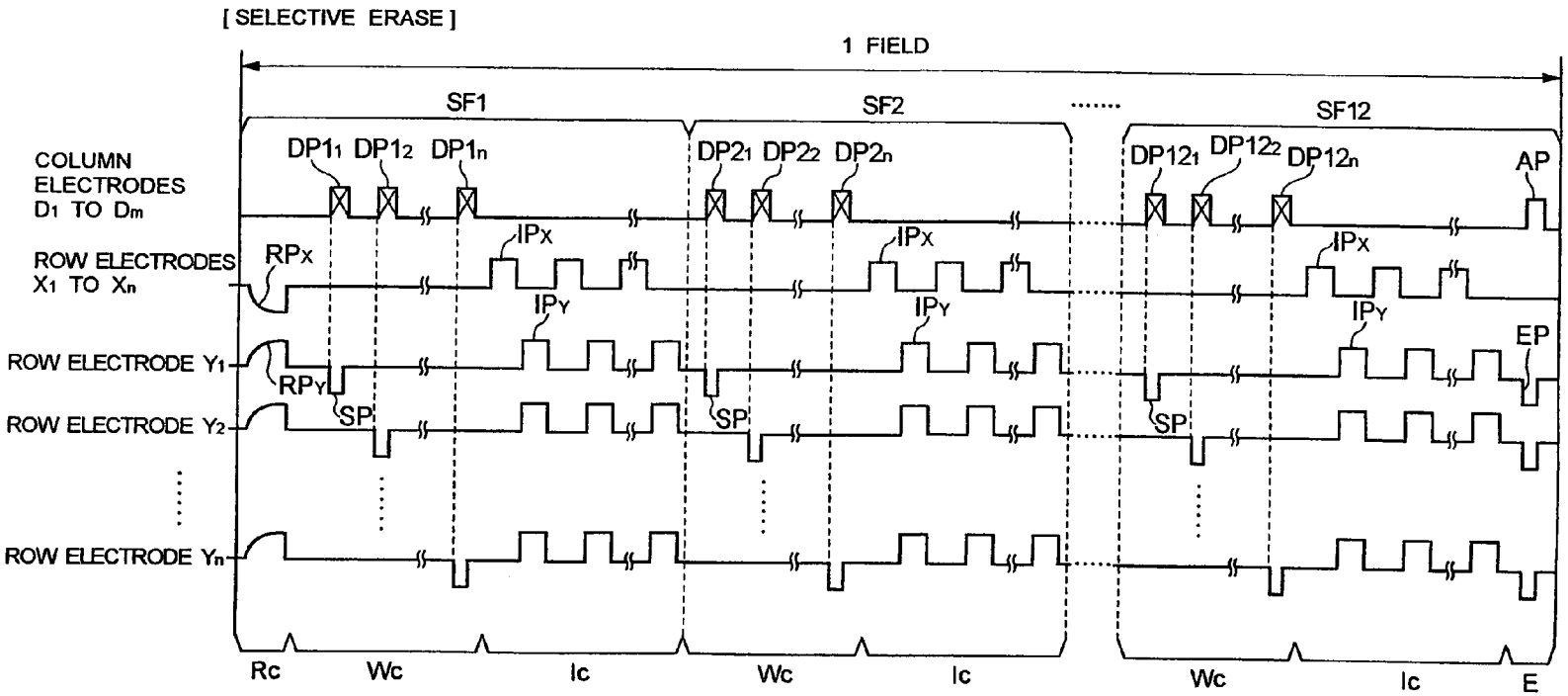
FIG. 3 PRIOR ART
FIG. 3 is a diagram showing the timing for applying the various driving pulses, which are applied to the row electrodes and column electrodes of the PDP in accordance with the emission driving format shown in FIG. 2.
Figure 4:
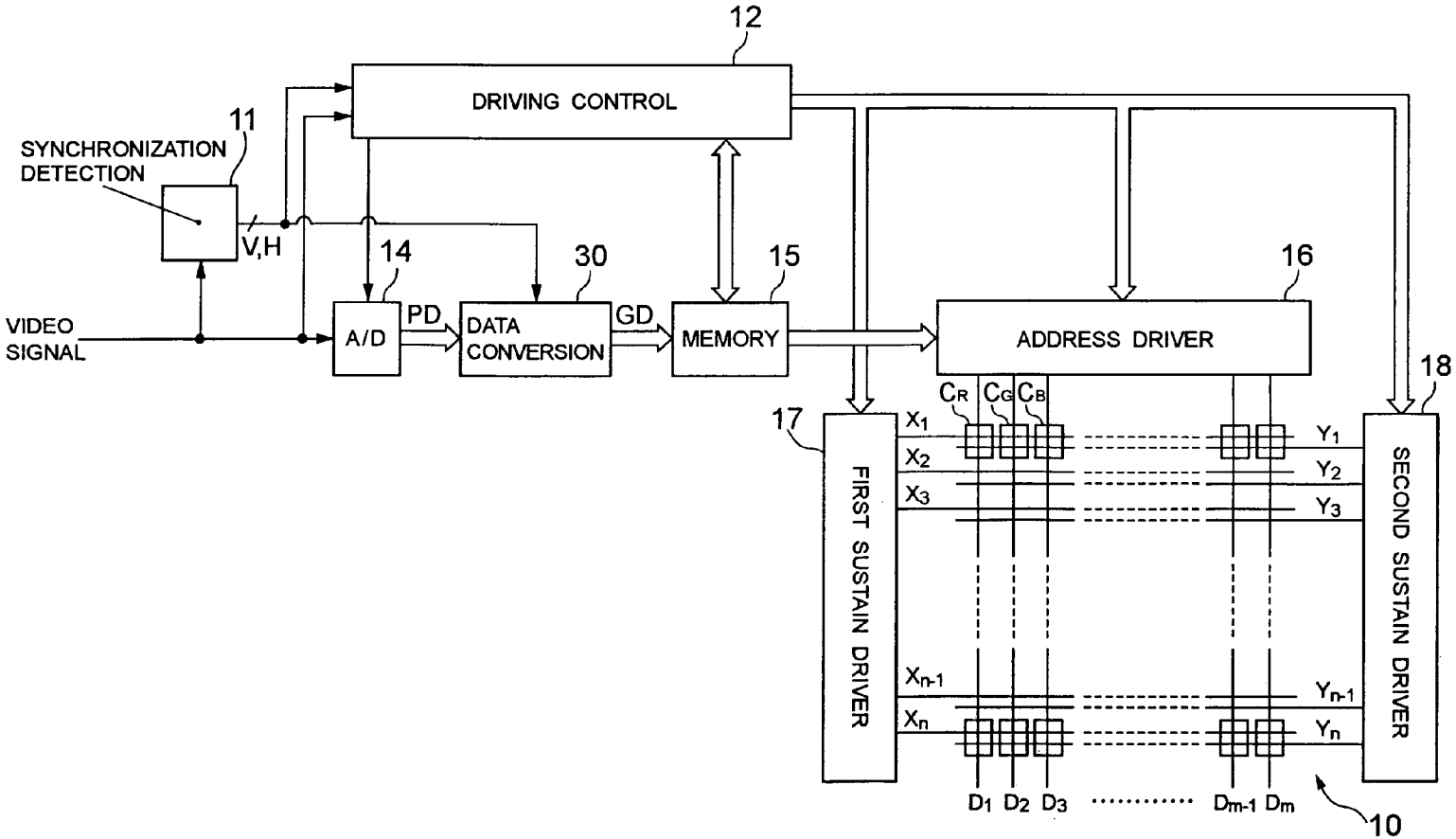
FIG. 4 is a diagram showing an overall configuration of a display device according to the present invention.

FIG. 4 shows an overall configuration of a plasma display device, according to the present invention.

The display device shown in FIG. 4 includes a PDP 10 as a plasma display panel, and a driving portion that drives the PDP 10. The driving portion includes a synchronization detection circuit 11, a driving control circuit 12, an A/D converter 14, a data conversion circuit 30, a memory 15, an address driver 16, a first sustain driver 17, and a second sustain driver 18.

The PDP 10 is provided with m column electrodes $D_1$ to $D_m$ as address electrodes, as well as row electrodes $X_1$ to $X_n$ and row electrodes $Y_1$ to $Y_n$ arranged perpendicularly to these electrodes. In the PDP 10, the row electrodes are formed such that a pair of a row electrode X and a row electrode Y corresponds to a single display line. The column electrodes $D_1$ to $D_m$ are distributed with the column electrodes $D_1, D_4, D_7, \ldots, D_{m-2}$ driving red light-emissions, the column electrodes $D_2, D_5, D_8, \ldots, D_{m-1}$ driving green light-emissions, and the column electrodes $D_3, D_6, D_9, \ldots, D_m$ driving blue light-emissions. Red discharge cells $C_R$ that discharge red light are formed at the intersections between the column electrodes $D_1, D_4, D_7, \ldots, D_{m-2}$ that drive red light-emissions and the row electrodes X and Y. Green discharge cells $C_G$ that discharge green light are formed at the intersections between the column electrodes $D_2, D_5, D_8, \ldots, D_{m-1}$ that drive green light-emissions and the row electrodes X and Y. Blue discharge cells $C_B$ that discharge blue light are formed at the intersections between the column electrodes $D_3, D_6, D_9, \ldots, D_m$ that drive blue light-emissions and the row electrodes X and Y. In this way, a single pixel is formed by three discharge cells, that is, a red discharge cell $C_R$, a green discharge cell $C_G$, and a blue discharge cell $C_B$, that are adjacent to one another along the display line.

The synchronization detection circuit 11 generates a vertical synchronization signal V when a vertical synchronization signal from the analog video signal is detected. Furthermore, the synchronization detection circuit 11 generates a horizontal synchronization signal H when a horizontal synchronization signal from the video signal is detected. The synchronization detection circuit 11 supplies the vertical synchronization signals V and horizontal synchronization signals H to the driving control circuit 12 and the data conversion circuit 30. The A/D converter 14 samples the video signal in response to a clock signal supplied from the driving control circuit 12, and converts the sampled video signal to pixel data PD (of for example 8 bits) for each pixel, which is then supplied to the data conversion circuit 30.

Figure 5:
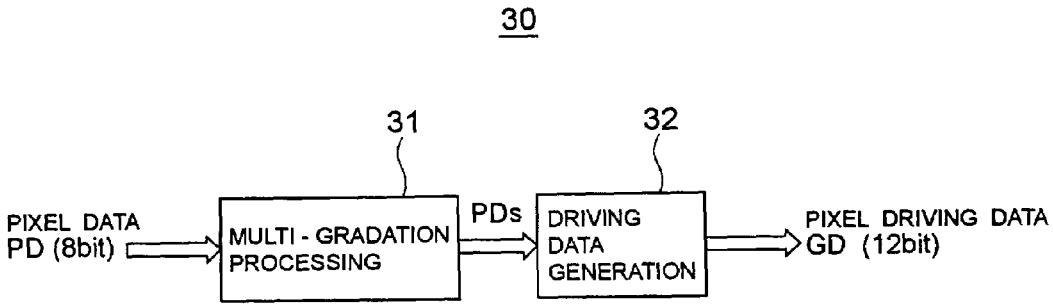
FIG. 5 is a diagram showing the internal configuration of the data conversion circuit 30.

FIG. 5 shows the internal configuration of the data conversion circuit 30.

The multi-gradation processing circuit 31 in FIG. 5 carries out error diffusion processing and dithering for the 8-bit pixel data PD. For example, in the error diffusion process, first the upper 6 bits of the pixel data PD are taken as the display data, and the remaining lower 2 bits are taken as error data. Then, the result of weighing and adding the error data of the pixel data PD corresponding to each of the surrounding pixels is reflected in the display data. With this operation, the luminance of the lower two bits in the original pixel is expressed artificially by the surrounding pixels. As a result, it is possible to express a luminance gradation that is equivalent to that of eight bits of pixel data with only six bits (that is, less than eight bits) of display data. Next, the six bits of error diffusion processed pixel data that have been obtained by the error diffusion process are subjected to a dithering process. In the dithering process, a plurality of adjacent pixels are taken as one pixel unit, and dithered pixel data are obtained by assigning and adding dither factors comprising different factors to the error diffusion processed pixel data corresponding to the pixels in the one pixel unit. With the addition of dither factors, it is possible to express a luminance that is equivalent to eight bits with only the four upper bits of the dithered pixel data, when looked at as one pixel unit. The multi-gradation processing circuit 31 supplies the four upper bits of the dithered pixel data as multi-gradation pixel data $PD_s$ to the driving data generating circuit 32.

The driving data generating circuit 32 converts the 4-bit multi-gradation processed pixel data $PD_s$ into pixel driving data GD comprising bits 1 to 12 in accordance with a conversion table such as that shown in FIG. 6. Note that the asterisk mark in the conversion table shown in FIG. 6 may be used to indicate either logic level 1 or 0.

The pixel data PD, which can express 256 gradations with 8 bits, is converted by the multi-gradation processing circuit 31 and the driving data generating circuit 32 into 12-bit pixel driving data GD comprising a total of 13 patterns such as shown in FIG. 6.

The memory 15 successively writes and stores the pixel driving data GD in accordance with the write signals being supplied from the driving control circuit 12. With this write operation, when the writing of one screen (n rows, m columns) of pixel driving data $GD_{1,1}$ to $GD_{n,m}$ is finished, the memory 15 successively reads out the pixel driving data $GD_{1,1}$ to $GD_{n,m}$ for one display line at a time (i.e. m items of pixel driving data) to the same bit position, in accordance with a read signal supplied from the driving control circuit 12, and supplies the data of that display line to the address driver 16. That is, the memory 15 handles one screen of 12-bit pixel driving data $GD_{1,1}$ to $GD_{n,m}$ as pixel driving data bit groups DB1 to DB12, which are divided into twelve as follows:

DB1: 1st bit of pixel driving data $GD_{1,1}$ to $GD_{n,m}$
DB2: 2nd bit of pixel driving data $GD_{1,1}$ to $GD_{n,m}$
DB3: 3rd bit of pixel driving data $GD_{1,1}$ to $GD_{n,m}$
DB4: 4th bit of pixel driving data $GD_{1,1}$ to $GD_{n,m}$
DB5: 5th bit of pixel driving data $GD_{1,1}$ to $GD_{n,m}$ -continued DB6: 6th bit of pixel driving data $GD_{1,1}$ to $GD_{n,m}$
DB7: 7th bit of pixel driving data $GD_{1,1}$ to $GD_{n,m}$
DB8: 8th bit of pixel driving data $GD_{1,1}$ to $GD_{n,m}$
DB9: 9th bit of pixel driving data $GD_{1,1}$ to $GD_{n,m}$
DB10: 10th bit of pixel driving data $GD_{1,1}$ to $GD_{n,m}$
DB11: 11th bit of pixel driving data $GD_{1,1}$ to $GD_{n,m}$
DB12: 12th bit of pixel driving data $GD_{1,1}$ to $GD_{n,m}$.

At this point, the pixel driving data bit groups DB1 to DB12 correspond to sub-fields SF1 to SF12, which will be discussed later. The memory 15 reads out the pixel driving data bit group DB corresponding to the sub-field at that point in time for each display line one at a time, in correspondence with a read signal supplied from the driving control circuit 12, and supplies the pixel driving data bit groups to the address driver 16.

In synchronization with the horizontal synchronization signal H and the vertical synchronization signal V, the driving control circuit 12 generates a clock signal for the A/D converter 14, as well as write and read signals for the memory 15.

Figure 7:
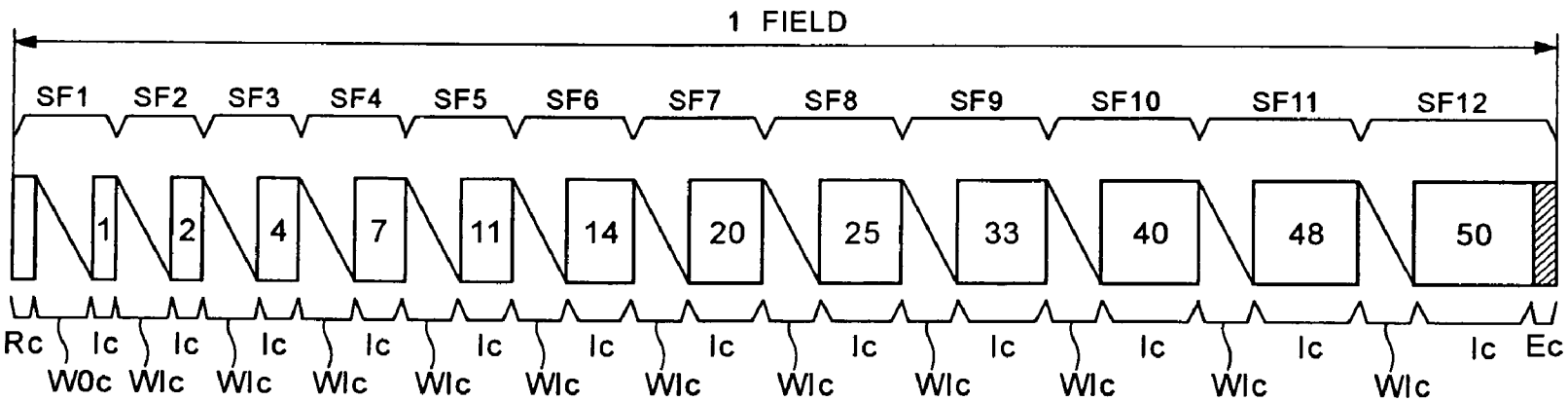
FIG. 7 is a diagram showing an emission driving format for driving the PDP 10.

Furthermore, in accordance with an emission driving format such as that in FIG. 7, the driving control circuit 12 supplies the various kinds of timing signals required for driving the PDP 10 to the address driver 16, the first sustain driver 17, and the second sustain driver 18.

With the emission driving format shown in FIG. 7, one field of the video signal is divided into twelve sub-fields SF1 to SF12, and an addressing step and an emission sustain step Ic are executed in each of the sub-fields. A selective write addressing step WOc is executed in the leading sub-field SF1, and a selective erasing step WIc is executed in the sub-fields SF2 to SF12 thereafter. Also, the universal reset step Rc is executed only in the leading sub-field SF1, and an erasing step Ec is executed only in the last sub-field SF12.

Figure 8:
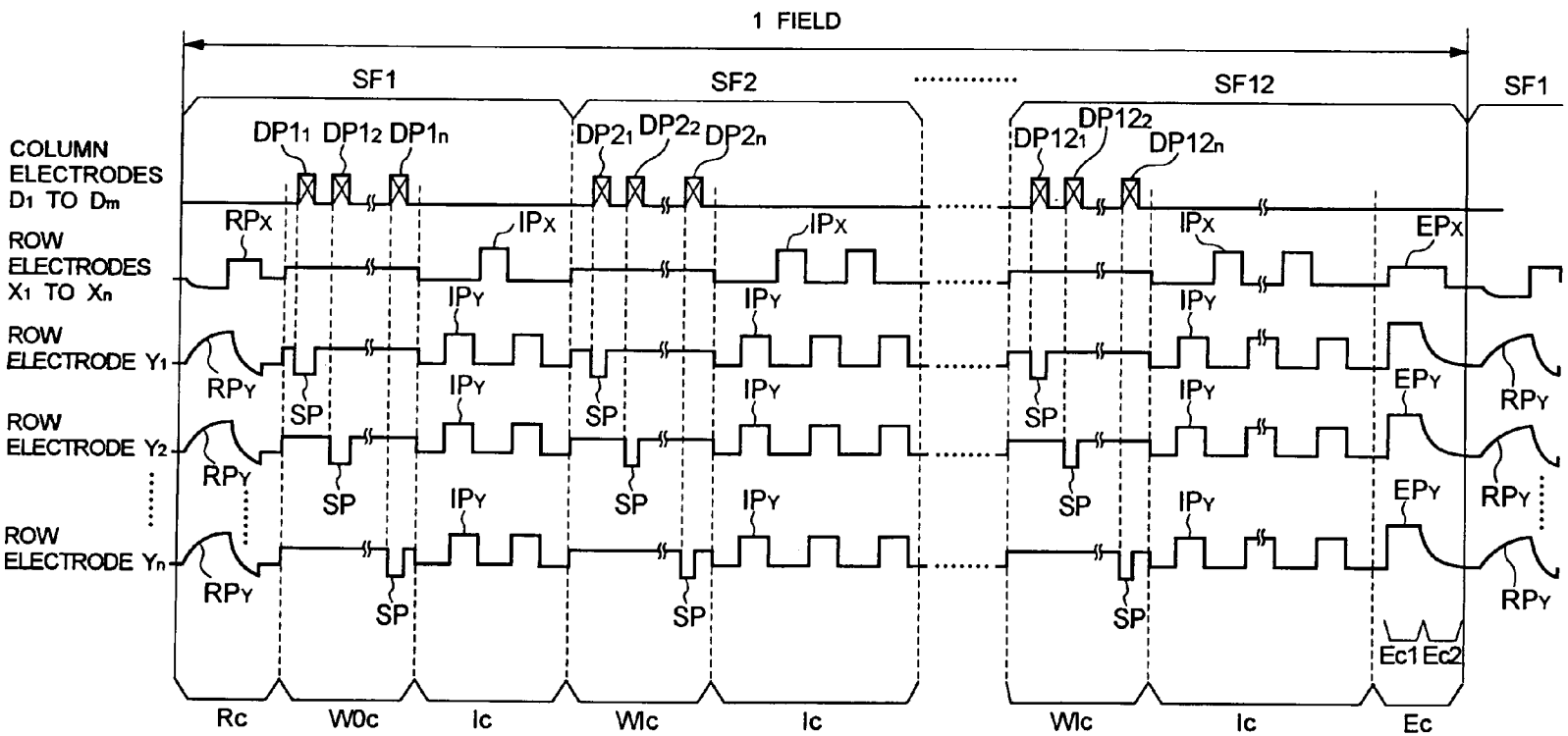
FIG. 8 is a diagram showing the timing chart for the application of the various kinds of driving pulses that are applied to the row electrodes and column electrodes of the PDP 10 in accordance with the emission driving format shown in FIG. 7.

FIG. 8 is a time chart showing the timing for the application of the various kinds of driving pulses that are applied to the row electrodes and column electrodes of the PDP 10 by the address driver 16, the first sustain driver 17, and the second sustain driver 18, in accordance with the emission driving format shown in FIG. 7.

Figure 9A:
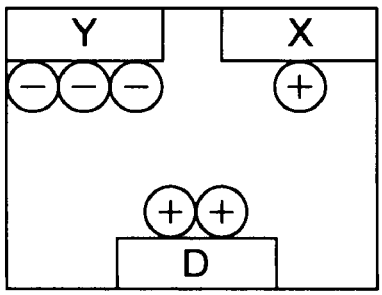
FIGS. 9A and 9B are diagrams schematically showing a charge formation state in the discharge cells when there is a wall charge and when there is no wall charge.
Figure 9B:
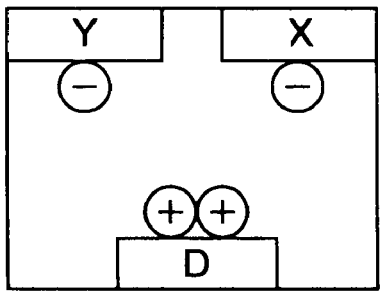

First, in the universal reset step Rc of the sub-field SF1, the second sustain driver 18 applies the positive reset pulses $RP_Y$ shown in FIG. 8 to the row electrodes $Y_1$ to $Y_n$. It should be noted that, as shown in FIG. 8, the level transitions of the rise and fall intervals of the reset pulses $RP_Y$ are more gently sloped than those of the sustain pulse IP that will be discussed later. A first reset discharge is induced between the row electrodes Y and the column electrodes D of all the discharge cells of the PDP 10 in response to the application of the reset pulses $RP_Y$. After the first reset discharge terminates, a negative charge is formed near the row electrode Y, a positive charge is formed near the column electrode D, and a positive charge is formed near the row electrode X in each of the discharge cells as shown in FIG. 9A. When a negative voltage is applied to the row electrodes Y at this point, a discharge is induced between the row electrodes X and Y. Consequently, in the following, the state in which charges of different polarities are formed near the row electrodes X and Y, as shown in FIG. 9A, is referred to as a state in which a wall charge is formed. Furthermore, in the universal reset step Rc, the first sustain driver 17 applies the positive reset pulses $RP_X$ shown in FIG. 8 to the row electrodes $X_1$ to $X_n$ immediately after the application of the reset pulses $RP_Y$. During that time, the voltage of the falling interval of the reset pulses $RP_Y$ is applied to the row electrodes $Y_1$ to $Y_n$ as shown in FIG. 8. In response to the application of the reset pulses $RP_X$, a second reset discharge is induced between the row electrodes X and Y in all the discharge cells of the PDP 10. After the second reset discharge terminates, the charge formed within each discharge cell transitions to the form shown in FIG. 9B. That is, the charges formed near the row electrodes X and Y transition together to a negative charge. At this point, for example, even if a negative charge is applied to the row electrodes X (or Y), a discharge is not induced. Consequently, hereinafter, the state in which charges of the same polarity remain near the row electrodes X and Y, as shown in FIG. 9B, is referred to as a state in which a wall charge is not present.

Consequently, with the universal reset step Rc, the wall charges are extinguished from all the discharge cells, and the discharge cells are initialized to the "lighted discharge cell mode."

Next, in the selective write addressing step WOc of the leading sub-field SF1, the second sustain driver 18 successively applies a negative scan pulse SP to the row electrodes $Y_1$ to $Y_n$. During this time, the address driver 16 converts each of the pixel driving data bits of the pixel driving data bit group DB1 (the 1st bit of the pixel driving data GD shown in FIG. 6) that is read out one display line (m pixels) at a time from the memory 15 to pixel data pulses that have a pulse voltage corresponding to that logic level. For example, when the logic level of the pixel driving data bit is "1" the address driver 16 generates a high-voltage pixel data pulse, and a low-voltage (zero volt) pixel data pulse when the logic level is "0." Then, the address driver 16 successively applies as shown in FIG. 8, with a timing in synchronization with each scan pulse SP, the pixel data pulse groups $DPL_1$, $DP1_2$, . . . , $DP1_n$, each of which is made up of m pixel data pulses corresponding to the 1st display line to the n-th display line, to the column electrodes $D_1$ to $D_m$. At this point, a discharge (a selective write discharge) is induced only in the discharge cells at the intersections between the row electrodes to which a scan pulse SP has been applied, and the column electrodes to which a high-voltage pixel data pulse has been applied, and a wall charge is formed in those discharge cells. On the other hand, no discharge is induced in discharge cells to which, although a scan pulse SP has been applied, no high-voltage pixel data pulse has been applied, and no wall charge is formed in these discharge cells.

Consequently, in the selective write addressing step WOc, by selectively forming wall charges in the discharge cells of the PDP 10 in accordance with the pixel driving data GD as shown in FIG. 6, each discharge cell is set to either the "lighted discharge cell mode" in which a wall charge is present, or the "unlighted discharge cell mode" in which no wall charge is present.

Furthermore, in the selective erasure addressing steps WIc of the sub-fields SF2 to SF12, the second sustain driver 18 successively applies a negative scan pulse SP to the row electrodes $Y_1$ to $Y_n$. During this time, the address driver 16 converts each of the pixel driving data bits of the pixel driving data bit groups DB that are read out one display line (m pixels) at a time from the memory 15 to pixel data pulses that have a pulse voltage corresponding to that logic level. For example, when the logic level of the pixel driving data bit is "1", the address driver 16 generates a high-voltage pixel data pulse, and a low-voltage (zero volt) pixel data pulse when the logic level is "0." Then, the address driver 16 applies, with a timing in synchronization with each scan pulse SP, the pixel data pulse groups DP, which comprise m number pixel data pulses corresponding to the 1st display line to the n-th display line, to the column electrodes $D_1$ to $D_m$. For example, in sub-field SF2, the pixel data pulse groups DP2$_1$, DP2$_2$, . . . , DP$_n$, each of which comprise m pixel data pulses, are successively applied, as shown in FIG. 8, to the column electrodes $D_1$ to $D_m$ with a timing in synchronization with the scan pulses SP. Furthermore, in the sub-field SF12, the pixel data pulse groups DP12$_1$, DP12$_2$, . . . , DP12$_n$, each of which comprise m pixel data pulses, are successively applied, as shown in FIG. 8, to the column electrodes $D_1$ to $D_m$ with a timing in synchronization with the scan pulses SP. At this point, a discharge (a selective erasing discharge) is induced only in the discharge cells at the intersections between the row electrodes to which a scan pulse SP has been applied and the column electrodes to which a high-voltage pixel data pulse has been applied. The wall charges formed inside the discharge cells are extinguished in response to these selective erasing discharges. On the other hand, in the discharge cells in which no selective erasing discharge has been induced, although a scan pulse SP and a high-voltage pixel data pulse have been applied, the wall charge is sustained in the state in which it was until then.

Consequently, in the selective erasure addressing step WIc, by selectively erasing wall charges in the discharge cells of the PDP 10 in response to the pixel driving data GD as shown in FIG. 6, each discharge cell is set to either the "lighted discharge cell mode" in which a wall charge is present, or the "unlighted discharge cell mode" in which no wall charge is present.

Next, in the emission sustain step Ic of the sub-fields SF1 to SF12, the first sustain driver 17 and the second sustain driver 18 alternately apply positive sustain pulses $IP_Y$ and $IP_X$ to the row electrodes $X_1$ to $X_n$ and $Y_1$ to $Y_n$ as shown in FIG. 8. The number of times the sustain pulses IP are repetitively applied in the emission sustain step Ic of the sub-fields SF1 to SF12 is as shown in FIG. 7 for example:

SF1=1
SF2=2
SF3=4
SF4=7
SF5=11
SF6=14
SF7=20
SF8=25
SF9=33
SF10=40
SF11=48
SF12=50

At this point, only the discharge cells in which a wall charge is formed, that is, only the discharge cells which are set to the "lighted discharge cell mode," sustain their discharge each time the sustain pulse $IP_X$ or $IP_Y$ is applied.

Consequently, with the emission sustain step Ic, only the discharge cells set to the "lighted discharge cell mode" in the selective write addressing step WOc and the selective erasure addressing step WIc of each sub-field emit light for a number of times corresponding to the weighting of that sub-field.

With the driving shown in FIGS. 7 and 8, the selective write addressing step WOc of the sub-field SF1 is the only opportunity in the sub-fields SF1 to SF12 at which a discharge cell can be caused to transition from the "unlighted discharge cell mode" to the "lighted discharge cell mode." That is, a selective erasing discharge is induced at only one sub-field within the sub-fields SF1 to SF12, and once a discharge cell has been set to the "unlighted discharge cell mode," that discharge cell does not return to the "lighted discharge cell mode" in subsequent sub-fields. Consequently, with the thirteen levels of gradation driving with the pixel driving data GD shown in FIG. 6, with the exception of the 1st gradation driving expressing the lowest luminance "0", a selective write discharge (indicated by double circles) is always induced in the selective write addressing step WOc of the leading sub-field SF1, setting the discharge cell to the "lighted discharge cell mode." The "lighted discharge cell mode" is sustained only for the number of consecutive sub-fields corresponding to the level of luminance to be expressed, with consecutive sustain discharges being induced in the emission sustain step Ic of each sub-field therein indicated by white circles. Note that the discharge cells are sustained in the "lighted discharge cell mode" for the period until a selective erasing discharge (indicated by black circles) is induced in the selective erasure addressing step WIc of one sub-field within sub-fields SF2 to SF12.

Intermediate gradations of luminance are expressed here depending on the total number of sustain discharges induced in the sub-fields SF1 to SF12.

That is, 13 gradations of intermediate luminance can be expressed with the pixel driving data GD having 13 data patterns as shown in FIG. 6: [0:1:3:7:14:25:39:59:84:117:157:205:255]

With this driving method, as shown in FIG. 6, when executing the 1st gradation driving that expresses the lowest luminance "0", no selective write discharge or selective erasing discharge is induced in any of the sub-fields SF1 to SF12.

Thus, it is possible to inhibit the deterioration in dark contrast caused by light emissions accompanying the selective write discharges and selective erasing discharges.

Figures 10A, 10B, 10C, 10D, 10E, 10F:
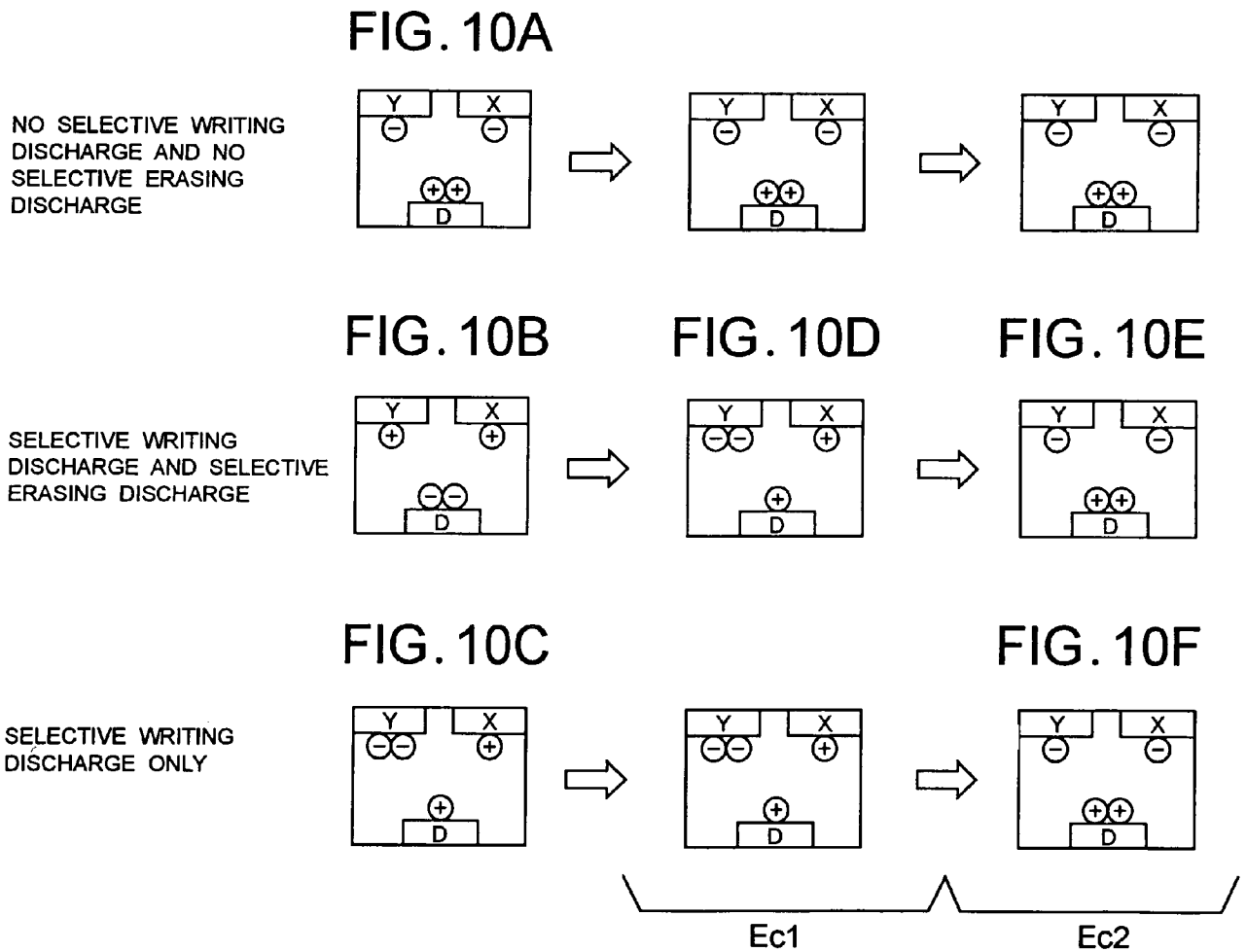
FIGS. 10A to 10F are diagrams schematically illustrating transitions of the charge formation states in the discharge cells at the erasing step Ec.

Furthermore, with this driving method, the state of the formation of wall charges in discharge cells at the time of completion of the emission sustain step Ic in the sub-field SF12 is different for the 1st gradation driving, the 2nd to 12th gradation drivings, and the 13th gradation driving, as shown in FIG. 6. That is, with the 1st gradation driving, in which no selective write discharge or selective erasing discharge whatsoever is induced in any of the sub-fields SF1 to SF12, the state of the formation of wall charges in the discharge cells when the emission sustain step Ic of the sub-field SF12 is completed is as shown in FIG. 10A. Furthermore, with the 2nd to 12th gradation drivings, in which a selective erasing discharge is induced in one of the sub-fields of sub-fields SF2 to SF12, the state of the formation of wall charges in the discharge cells is as shown in FIG. 10B. Furthermore, with the 13th gradation driving, in which, although a selective write discharge is induced in the sub-field SF1, no selective erasing discharge whatsoever is induced in the subsequent sub-fields, the state of the formation of wall charges in the discharge cells is as shown in FIG. 10C. Consequently, once variations develop in the state of the formation of the charge for each discharge cell as in the FIGS. 10A to 10C, it is impossible to align the charge formations of all the discharge cells uniformly as in the state shown in FIG. 9B, even when a universal reset step Rc is executed in the sub-field SF1 of the next field for example. Therefore, there is the possibility of erroneous discharges being induced in the selective write addressing step WOc and the selective erasure addressing step WIc, and there is the risk that the display quality will deteriorate. For this reason, the erasing step Ec is executed immediately after the emission sustain step Ic of the last sub-field SF12 for each field.

In the erasing step Ec, the second sustain driver 18 generates positive erasing pulses $EP_Y$ with steeply-rising edges and gently-falling edges, and these pulses $EP_Y$ are applied simultaneously to each of the row electrodes $Y_1$ to $Y_n$. Furthermore, while these erasing pulses $EP_Y$ are being applied, the first sustain driver 17 generates positive erasing pulses $EP_X$ as shown in FIG. 8, and the pulses $EP_Y$ are applied simultaneously to each of the row electrodes $X_1$ to $X_n$.

In this erasing step Ec, while the erasing pulses $EP_Y$ are sustained at a constant high voltage, a first erasing discharge is induced between the row electrodes Y and the column electrodes D (first erasing step Ec1), only in the discharge cells in the state shown in FIG. 10B. With this first erasing discharge, the positive charge formed near the row electrodes Y of these discharge cells transitions to a negative charge, as shown in FIG. 10D, and the negative charge formed near the column electrode D transitions to a positive charge. Note that during this time, the first erasing discharge as described above is not induced in the discharge cells in the state shown in FIG. 10A or the discharge cells in the state shown in FIG. 10C. Thus, while the erasing pulses $EP_Y$ are sustained at a constant high voltage, the discharge cells in the state of FIG. 10A and the discharge cells in the state of FIG. 10C are sustained in their current charge formation state. Consequently, by inducing the first erasing discharge, the charge formation state within the discharge cells in which the selective erasing discharge was induced is the same as the charge formation state in the discharge cells in which no selective erasing discharge was induced, even though a selective writing discharge was induced, as shown in FIG. 10C.

After that, the level of the erasing pulses $EP_Y$ is gradually decreased, and when the level reaches a predetermined level, a second erasing discharge is induced between the row electrodes Y and X only in the discharge cells that are in the state as shown in FIG. 10C (second erasing step Ec2). With this second erasing discharge, the positive charge formed near the row electrode X transitions to a negative charge, as shown FIG. 10E and FIG. 10F. By executing a second erasing step Ec2, discharge cells in which no selective writing discharge and no selective erasing discharge was induced as well as the discharge cells in which both of the two types of discharges were induced and discharge cells in which only a selective erasing discharge was induced all take on a state in which no wall charge is formed, as shown in FIG. 9B. Thus, erroneous discharges in the addressing step can be prevented, avoiding a deterioration of the display quality.

Figure 11:
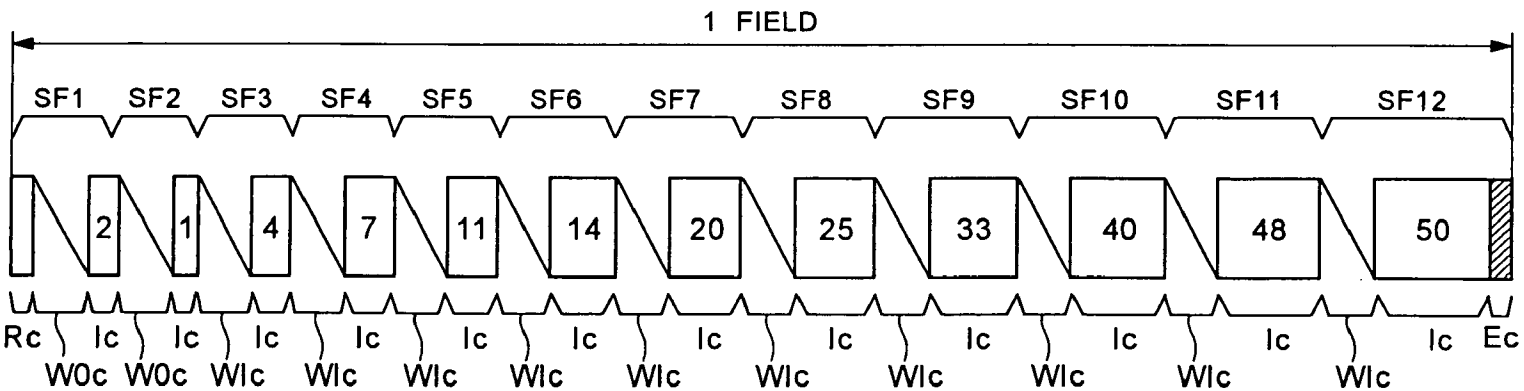
FIG. 11 is a diagram showing another example of an emission driving format for driving the PDP 10.

In the above-described embodiment, the selective writing addressing step WOc in which the discharge cells are selectively set to the "lighted discharge cell mode" is executed only in the leading sub-field SF1, but as shown in FIG. 11, it is also possible to execute the addressing step WOc again in the following sub-field SF2. In this case, the number of sustain pulses IP that should be applied to the row electrodes X and Y of the PDP 10 in the emission sustain steps Ic of the sub-fields SF1 and SF2 is SF1=2 and SF2=1, as shown in FIG. 11. Moreover, if the PDP 10 is driven in accordance with the emission driving format shown in FIG. 11, then a conversion table as shown in FIG. 12 is employed for the driving data generating circuit 32. Consequently, the emission driving pattern based on the pixel driving data GD is configured as shown in FIG. 12.

That is to say, a selective writing addressing step is executed at the leading sub-field or at a plurality of successive sub-fields including the leading sub-field, and after that a selective erasure addressing step is executed at each of the following sub-fields. By driving in this manner, a selective writing discharge is induced in the selective writing addressing step, except when expressing zero luminance. When expressing zero luminance, neither a selective erasing discharge nor a selective writing discharge are induced, so that it is possible to improve the dark contrast.

Moreover, by executing, at the end of each field, the first erasing step Ec1 and the second erasing step Ec2 in order to equalize the charge formation state in the discharge cells, erroneous discharges at the selective writing addressing step and the selective erasure addressing step are prevented. Thus, the dark contrast can be improved without compromising the display quality.

This application is based on a Japanese patent application No. 2002-268887 which is hereby incorporated by reference.

What is claimed is:

1. A method for driving a display panel in which discharge cells are formed at intersections between a plurality of row electrode pairs corresponding to display lines, and a plurality of column electrodes intersecting with said row electrode pairs, said display panel being driven in sub-fields, each field of a video signal being constituted by a plurality of said sub-fields, wherein:

each of at least two successive sub-fields including a leading sub-field includes a selective write addressing step for setting said discharge cells to a lighted discharge cell mode by applying a scan pulse to one row electrode of said row electrode pair while applying a data pulse corresponding to said video signal to said column electrode thereby selectively causing a selective writing discharge in said discharge cells;

the sub-fields following said at least two sub-fields include a selective erasure addressing step for setting said discharge cells to an unlighted discharge cell mode by applying said scan pulse to one row electrode of said row electrode pair while applying the data pulse corresponding to said video signal to said column electrode thereby selectively causing a selective erasing discharge in said discharge cells; and an emission sustain step for applying sustain pulses to said row electrode pairs thereby causing a sustain discharge to be repeated a number of times corresponding to a weighting of that sub-field only in said discharge cells that are in said lighted discharge cell mode;

the last sub-field of each field includes a first erasing step for applying a first voltage to one row electrode of said row electrode pair and applying at a same time a second voltage to the other row electrode of said row electrode pair to induce a first erasing discharge between said column electrode and said one row electrode of said row electrode pair in only discharge cells in which both said selective writing discharge and said selective erasing discharge have been caused in each field, said first voltage and said second voltage have the same polarity; and a second erasing step for inducing a second erasing discharge between the row electrodes of said row electrode pair in only discharge cells in which said selective writing discharge has been caused without said selective erasing discharge in each field, said first erasing step and said second erasing step being performed immediately after said emission sustain step.

2. The method for driving a display panel according to claim 1, further comprising a reset step for initializing all of said discharge cells to said unlighted discharge cell mode by causing a universal reset discharge in all discharge cells before said selective write addressing step in only said leading sub-field.

3. The method for driving a display panel according to claim 1, wherein intermediate luminance of N+1 gradations is displayed by inducing sustain discharges in said emission sustain steps of N leading sub-fields of each field.

4. The method for driving a display panel according to claim 1, wherein only said last sub-field of each field includes said first erasing step and said second erasing step.

5. A method for driving a display panel in which discharge cells are formed at intersections between a plurality of row electrode pairs corresponding to display lines, and a plurality of column electrodes intersecting with said row electrode pairs, said display panel being driven in sub-fields, each field of a video signal being constituted by a plurality of said sub-fields, wherein:

a leading sub-field of each field includes a selective write addressing step for setting said discharge cells to a lighted discharge cell mode by applying said scan pulse to one row electrode of said row electrode pair while applying a data pulse corresponding to said video signal to said column electrode thereby selectively causing a selective writing discharge in said discharge cells;

the sub-fields following said leading sub-field include a selective erasure addressing step for setting said discharge cells to an unlighted discharge cell mode by applying said scan pulse to one row electrode of said row electrode pair while applying the data pulse corresponding to said video signal to said column electrode thereby selectively causing a selective erasing discharge in said discharge cells; and an emission sustain step for applying sustain pulses to said row electrode pairs thereby causing a sustain discharge repeated a number of times corresponding to a weighting of that sub-field only in said discharge cells that are in said lighted discharge cell mode;

the last sub-field of each field includes a first erasing step for applying a first voltage to one row electrode of said row electrode pair and applying at a same time a second voltage to the other row electrode of said row electrode pair to induce a first erasing discharge between said column electrode and said one row electrode of said row electrode pair in only discharge cells in which both said selective writing discharge and said selective erasing discharge have been caused in each field, said first voltage and said second voltage have the same polarity; and a second erasing step for inducing a second erasing discharge between the row electrodes of said row electrode pair in only discharge cells in which said selective writing discharge has been caused without said selective erasing discharge in each field, said first erasing step and said second erasing step being performed immediately after said emission sustain step.

6. The method for driving a display panel according to claim 5, further comprising a reset step for initializing all of said discharge cells to said unlighted discharge cell mode by causing a universal reset discharge in all discharge cells before said selective write addressing step in only said leading sub-field.

7. The method for driving a display panel according to claim 5, wherein intermediate luminance of N+1 gradations is displayed by inducing sustain discharges in said emission sustain steps of N leading sub-fields of each field.

8. The method for driving a display panel according to claim 5, wherein only said last sub-field of each field includes said first erasing step and said second erasing step.

* * * * *